US012630276B2

(12) United States Patent
Eagle

(10) Patent No.: US 12,630,276 B2
(45) Date of Patent: May 19, 2026

(54) END CAP APPARATUS FOR CANOE

(71) Applicant: Cedar Eagle, Carragana (CA)

(72) Inventor: Cedar Eagle, Carragana (CA)

( * ) Notice: Subject to any disclaimer, the term of this patent is extended or adjusted under 35 U.S.C. 154(b) by 0 days.

(21) Appl. No.: 18/187,265

(22) Filed: Mar. 21, 2023

(65) Prior Publication Data

US 2023/0322347 A1 Oct. 12, 2023

Related U.S. Application Data

(60) Provisional application No. 63/328,907, filed on Apr. 8, 2022.

(51) Int. Cl.
*B63H 20/06* (2006.01)
*B63B 34/26* (2020.01)
*B63B 34/21* (2020.01)

(52) U.S. Cl.
CPC ..... *B63H 20/06* (2013.01); *B63B 34/26* (2020.02); *B63B 34/21* (2020.02)

(58) Field of Classification Search
CPC ..... B63H 20/06; B63H 20/007; B63H 20/10; B63H 20/02; B63H 20/08; B63B 34/21; B63B 34/26

(Continued)

(56) References Cited

U.S. PATENT DOCUMENTS 1,100,954 A * 6/1914 Gaille ..... B63H 20/02 248/643
1,118,208 A * 11/1914 McLaren ..... B63H 20/06 248/641

(Continued)

FOREIGN PATENT DOCUMENTS

CA 2690227 6/2011
DE 202017001410 5/2017

(Continued)

OTHER PUBLICATIONS

Wilderness Systems Transom Trolling Motor Mount for Kayaks, amazon.ca, Sep. 11, 2020, [online] [retrieved on Jun. 19, 2024]. Retrieved from the internet <https://www.amazon.ca/Wilderness-Systems-Universal-Transom-Trolling/dp/B08HR9D9WV>.

(Continued)

*Primary Examiner* — Taylor Morris

(74) *Attorney, Agent, or Firm* — Kyle R Satterthwaite; Ryan W Dupuis; Ade & Company Inc.

(57) ABSTRACT

A canoe end cap that is configured to be secured to either the bow or stern of a canoe wherein a stern embodiment is further configured to have an outboard motor operably coupled thereto. The present invention includes a body wherein the body is manufactured from a durable rigid material. The body includes a top plate member having a first end and a second end wherein the width of the top plate member is greater proximate the first end. The top plate member includes a first lateral edge and a second lateral edge. A first side support member extends downward from the first lateral edge and a second side support member extends downward from the second lateral edge. First side support member and second side support member are adjacent to and parallel with opposing gunwales of the canoe. A motor mount assembly is configured to have a motor secured thereto.

20 Claims, 5 Drawing Sheets

(58) Field of Classification Search
USPC ..... 248/641
See application file for complete search history.

(56) References Cited

U.S. PATENT DOCUMENTS 1,141,196 A * 6/1915 McLaren ..... B63H 20/06 248/641
1,525,245 A * 2/1925 Langslow ..... B63B 5/12 114/355
2,475,889 A * 7/1949 Hafele ..... B63H 21/305 248/641
2,643,837 A * 6/1953 Rivers ..... B63H 20/10 248/240.4
2,669,733 A * 2/1954 Picker ..... B63B 27/14 182/83
2,842,086 A * 7/1958 Yost ..... B63H 20/06 248/641
2,899,769 A * 8/1959 Niles ..... A01K 97/10 248/530
2,928,631 A * 3/1960 Hartman ..... B63H 20/106 248/641
2,939,658 A * 6/1960 Roemer ..... B63H 20/08 248/641
3,241,511 A * 3/1966 Drtina ..... B63H 5/125 D12/309
3,325,127 A * 6/1967 Doskocil ..... A01K 97/10 248/499
3,601,344 A * 8/1971 Nourse ..... B63H 20/06 248/641
3,638,256 A * 2/1972 McIntyre ..... B63B 35/14 248/641
3,645,483 A * 2/1972 Bartosch ..... B63H 20/10 248/641
3,913,746 A * 10/1975 Burton ..... A47B 81/005 211/64
3,918,666 A * 11/1975 Florian ..... B63H 20/007 248/641
3,941,072 A * 3/1976 Caton ..... B63H 25/382 248/642
4,239,172 A * 12/1980 Spitzmesser ..... B63H 20/06 248/641
4,371,349 A * 2/1983 Edwards ..... B63H 20/007 440/56
4,515,335 A * 5/1985 DeRosett ..... B63B 45/02 114/364
4,690,649 A * 9/1987 Zeimet ..... B63H 20/06 248/641
4,819,905 A * 4/1989 McCain ..... B63H 20/007 114/364
5,137,249 A * 8/1992 Royster ..... B63H 20/007 248/642
5,322,030 A * 6/1994 Brehmer ..... B63B 35/665 248/641
5,679,036 A * 10/1997 Crawley ..... B63H 20/06 114/347
5,944,568 A * 8/1999 Rabal ..... B63H 20/106 440/58
6,447,348 B1 * 9/2002 Gilley ..... B63H 20/007 440/62
6,482,056 B1 * 11/2002 Schell-Tomczak .... B63H 20/06 248/641
7,153,064 B2 * 12/2006 Zeilinger ..... E02B 3/064 114/263
7,827,927 B2 * 11/2010 Kivi ..... B63B 21/00 114/294
8,221,175 B2 * 7/2012 Mynster ..... B63B 34/05 114/144 R
8,516,973 B1 * 8/2013 Hamilton ..... B63H 20/06 114/364
8,684,328 B2 * 4/2014 Mynster ..... B63H 20/08 248/231.51
8,944,867 B2 * 2/2015 Grovender ..... B63H 20/06 248/641
9,567,051 B2 * 2/2017 Schmidtke ..... B63H 23/24
9,758,227 B2 * 9/2017 Schmidtke ..... B63H 23/24
10,850,820 B1 * 12/2020 Minogue ..... B63H 20/06
11,584,495 B2 * 2/2023 Hunziker, II ..... B63H 20/06
2003/0194921 A1 * 10/2003 Leiss ..... B63H 20/06 440/6
2008/0078317 A1 * 4/2008 Furuya ..... B63H 20/08 114/144 R
2009/0101780 A1 * 4/2009 Revelino ..... F16M 11/18 248/274.1
2021/0253216 A1 * 8/2021 Covington ..... B63H 25/02

FOREIGN PATENT DOCUMENTS

DE 202017001410 U1 * 5/2017 ..... B63H 25/38
GB 2477377 A * 8/2011 ..... B63H 20/06

OTHER PUBLICATIONS

International search report, PCT/CA2024/050339.
Written Opinion of the International Searching authority, PCT/CA2024/050339, date of mailing Jun. 25, 2024.

* cited by examiner

END CAP APPARATUS FOR CANOE

FIELD OF THE INVENTION

The present invention relates generally to canoe accessories, more specifically but not by way of limitation, a device that is configured to be mounted over a stern end cap or a bow end cap of a canoe wherein the stern end cap configuration is further configured to have an outboard motor operably coupled thereto.

BACKGROUND

Outdoor recreation activities are engaged in by millions of people on a regular basis. Outdoor activities include but are not limited to hiking fishing and watersports. For the latter, there are numerous different types of watersports that range from powerboats, sailboats and paddle sports. Canoes are one of the many vessels that are designed to be paddled by the user. As is known in the art, canoes are available in various lengths and typically accommodate two to three people plus gear. There are seat intermediate the gunwales and the bow and stern of the canoe have a similar shape wherein the how and stern come to a point. The point on the bow and stern area of a conventional canoe typically has an end cap wherein the end cap is operably coupled to both starboard and port gunwales that lead into the end cap.

While canoes are designed for paddling as the primary means of propulsion, many canoers like to travel long distances and as such will mount motors onto the canoe to provide assistance in propulsion. While there are a few flat sterned canoes that are equipped for mounting motors thereto, mounting a motor to a conventional canoe can be challenging. Often times canoers will attempt to rig a mounting plate that extends across both port and starboard gunwales wherein the mounting plate is clamped into place. While this can be effective, it does have an adverse impact on the handling of the canoe due to the placement of the motor to the side of the canoe. Additionally, these devices can impose on seating as well.

Accordingly, there is a need for a canoe end cap that can be mounted to a canoe wherein the stern embodiment thereof is configured to have a motor mounted thereto wherein the propulsion is axially aligned with the keel of the canoe.

SUMMARY OF THE INVENTION

It is the object of the present invention to provide an end cap for a canoe that is configured to be secured to either the bow or the stern end cap of a canoe wherein the stern embodiment is configured to have operably coupled thereto an outboard motor.

Another object of the present invention is to provide an end cap for a canoe that can be secured to either the bow or stern of a canoe wherein the present invention includes a body manufactured from metal.

A further object of the present invention is to provide an end cap for a canoe that is configured to be secured to either the bow or the stern end cap of a canoe wherein the body of the present invention includes a top plate member that is generally triangular in shape having a first lateral edge and a second lateral edge.

Yet a further object of the present invention is to provide an end cap for a canoe that can be secured to either the bow or stern of a canoe wherein the body includes a first side support member and a second side support member extending downward from the first lateral edge and the second lateral edge respectively.

Still another object of the present invention is to provide an end cap for a canoe that is configured to be secured to either the bow or the stern end cap of a canoe wherein the first side support member and the second side support member includes a first section and a second section.

An additional object of the present invention is to provide an end cap for a canoe that can be secured to either the bow or stern of a canoe wherein the second section of the first side support member and the second side support member further includes a support portion wherein the support portion is comprised of a first segment and a second segment.

Yet a further object of the present invention is to provide an end cap for a canoe that can be secured to either the bow or stern of a canoe wherein the body further has operably coupled thereto on the stern embodiment thereof a motor mount.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
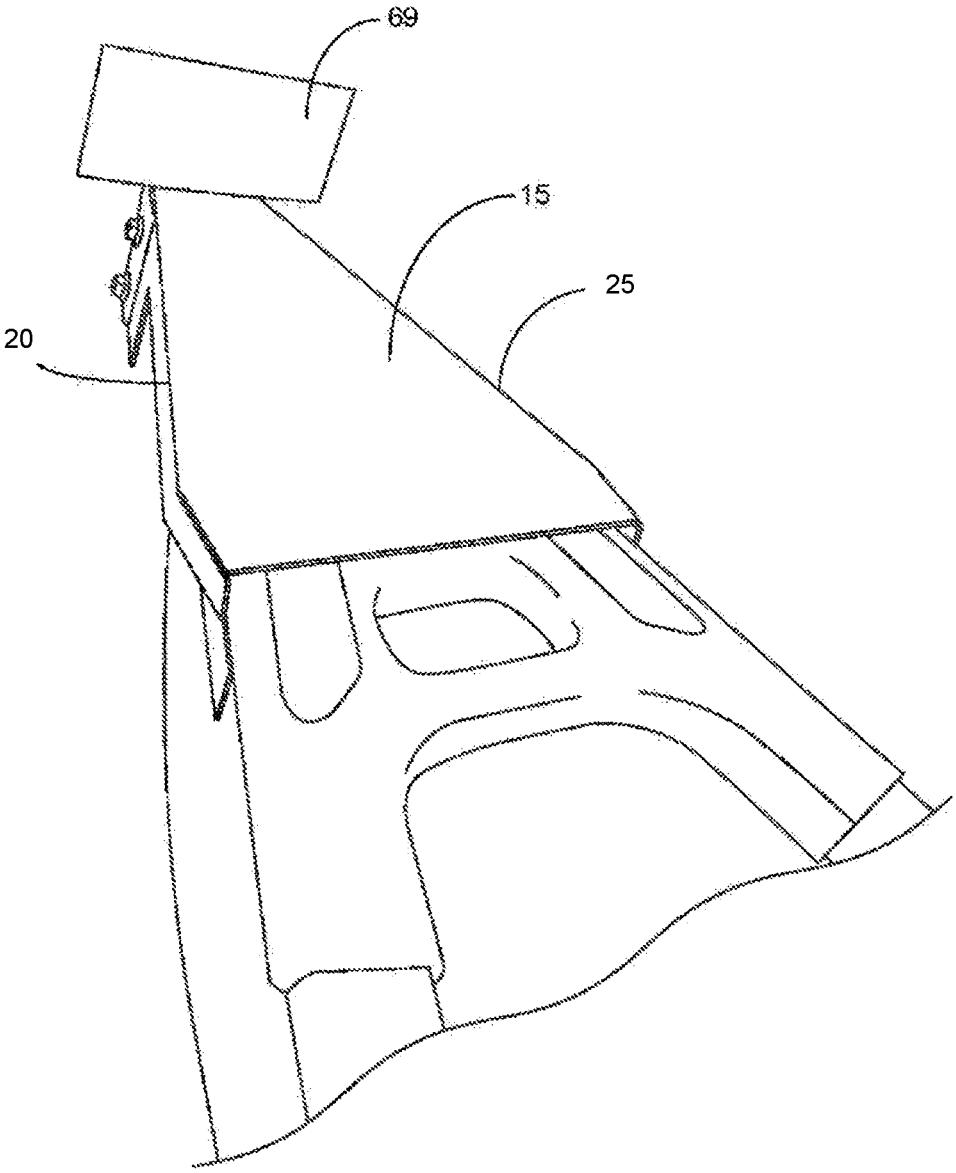
FIG. 1 is a top perspective view of the stern embodiment of the present invention.
Figure 2:
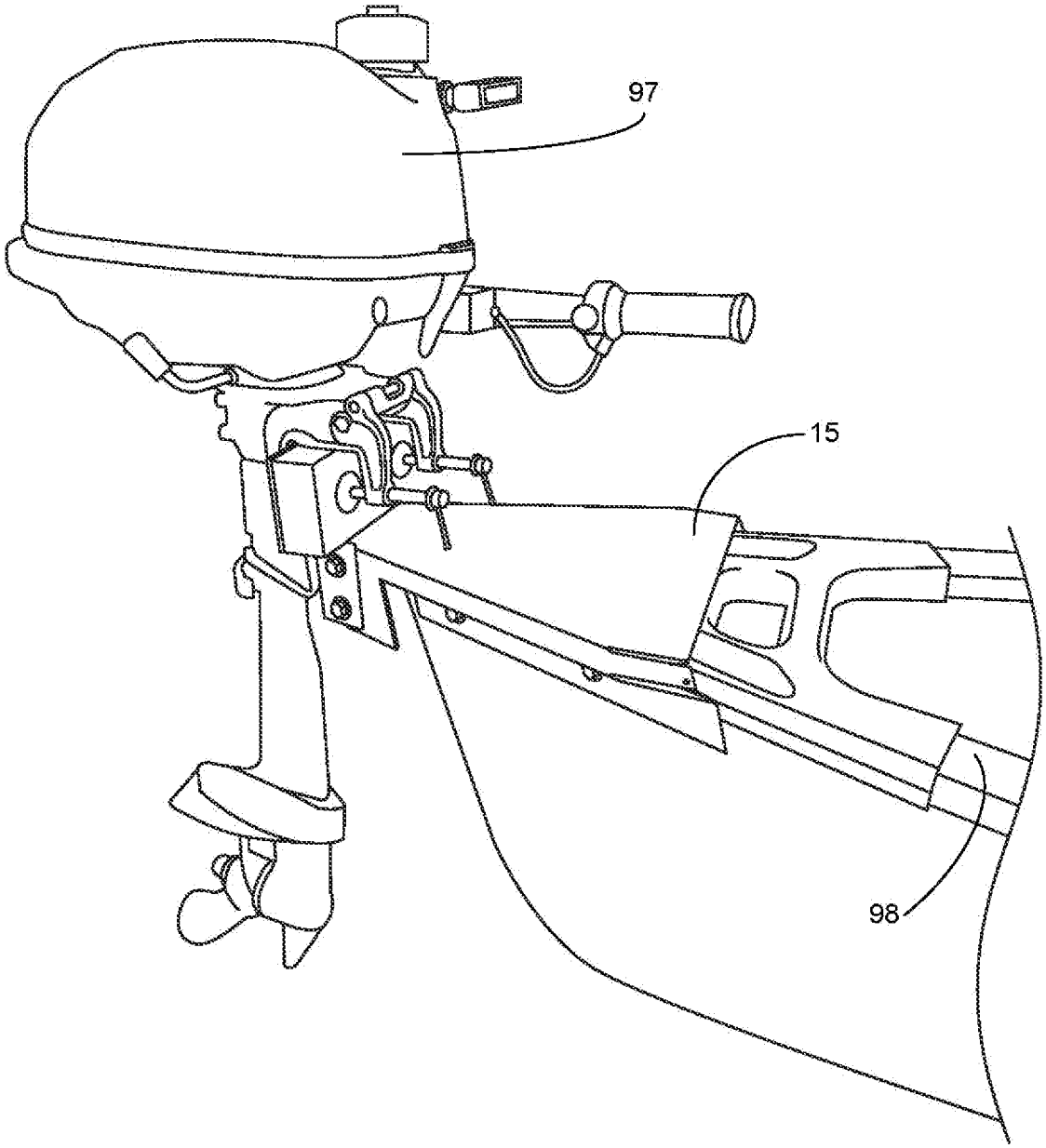
FIG. 2 is a side perspective view of the stern embodiment.
Figure 3:
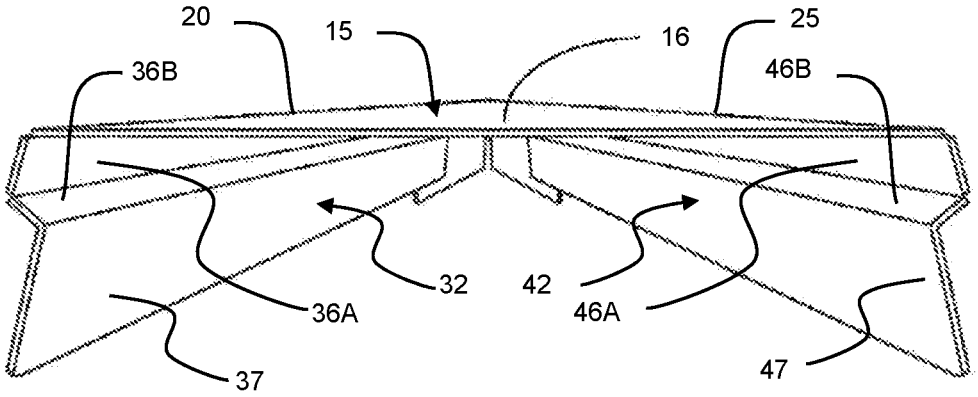
FIG. 3 is an end view of the body of the present invention.
Figure 4:
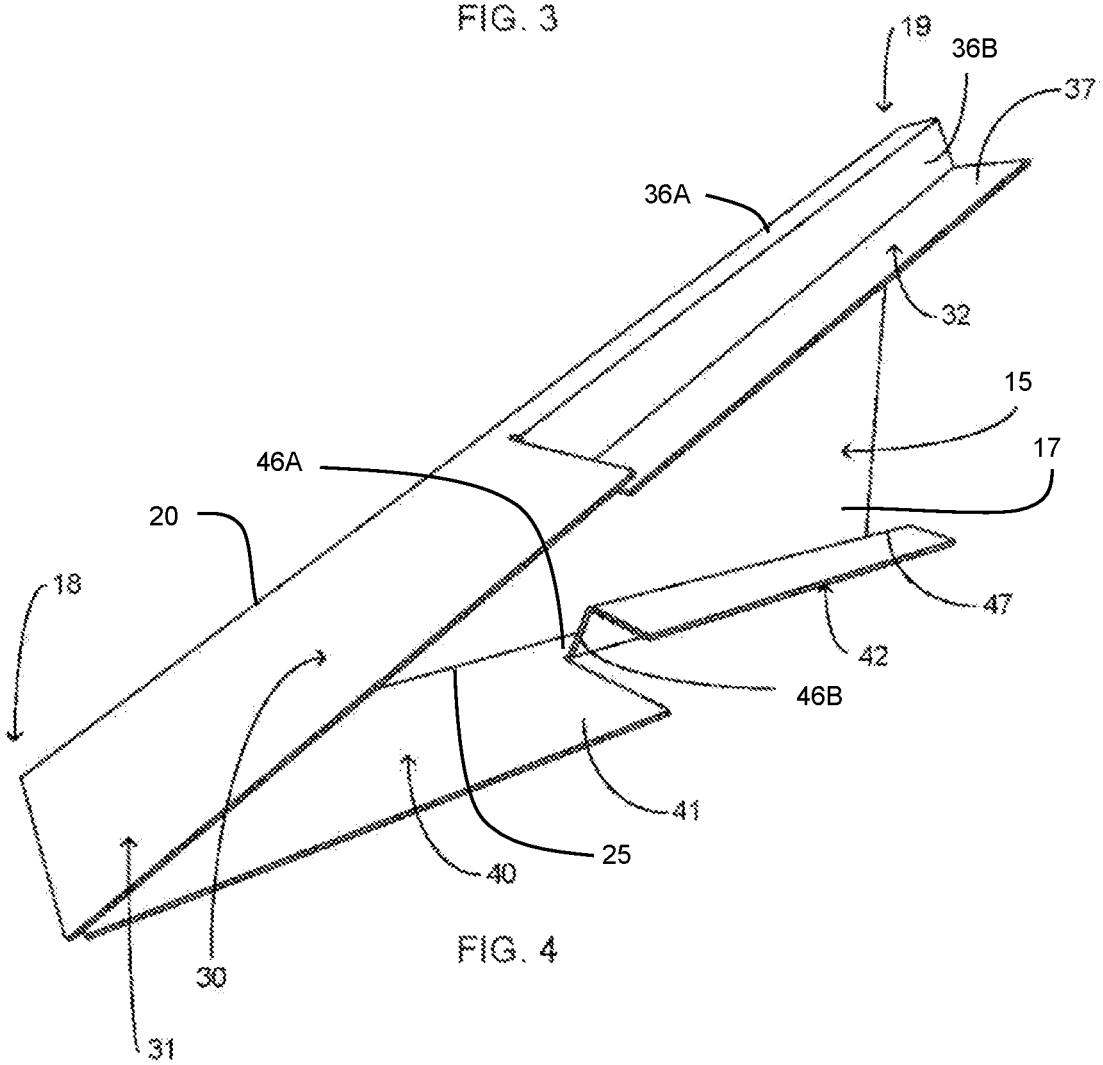
FIG. 4 is a bottom view of the present invention.
Figure 5:
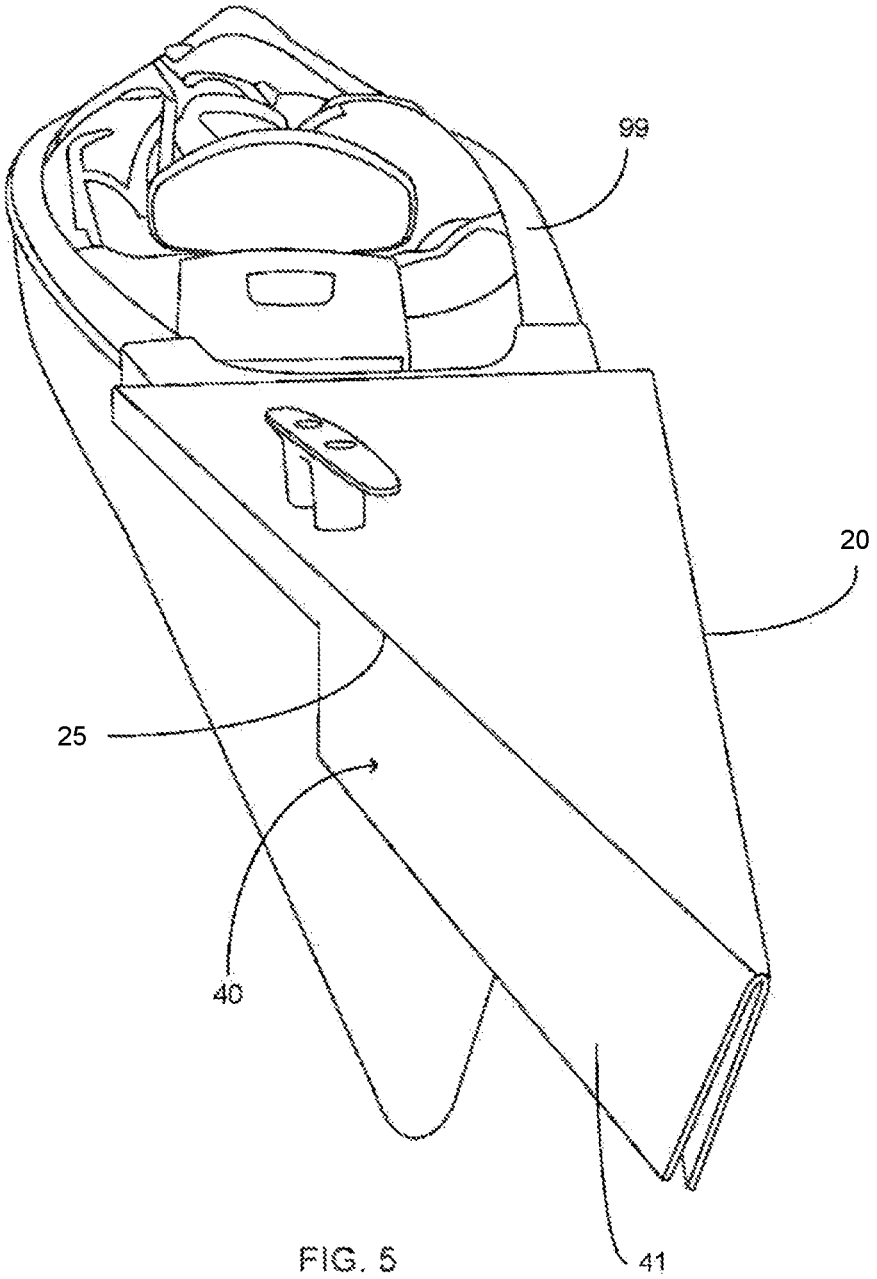
FIG. 5 is a top perspective view of a bow embodiment of the present invention.

Referring now to the drawings submitted herewith, wherein various elements depicted therein are not necessarily drawn to scale and wherein through the views and figures like elements are referenced with identical reference numerals, there is illustrated a canoe end cap 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the canoe end cap 100 includes a body 10 wherein the body 10 is manufactured from a suitable durable material such as but not limited to metal. It should be understood within the scope of the present invention that various manufacturing techniques could be employed to manufacture the body 10 which would be dependent upon the material utilized. The body 10 is shaped to be coupled to either the bow or stern of a canoe 99. While the body 10 is illustrated in a general triangular shape herein, it should be understood within the scope of the present invention that the body 10 could be provided in alternate shapes in order to mateably fit over an end of a canoe 99.

The body 10 includes a top plate member 15. The top plate member 15 is planar in manner having an upper surface 16 and a lower surface 17. The top plate member 15 includes a first end 18 and second end 19 wherein the second end 19 has a width that is greater than the width of the first end 18. Top plate member 15 includes first lateral edge 20 and second lateral edge 25 located on opposing sides of the top plate member 15. First lateral edge 20 and second lateral edge 25 extend intermediate first end 18 and second end 19. Extending downward from the first lateral edge 20 being contiguous therewith is the first side support member 30. The second side support member 40 is similarly positioned on the second lateral edge 25 extending downward therefrom being perpendicular thereto. The first side support member 30 and second side support member 40 extend downward from the gunwale of the canoe 99 and are adjacent the port and starboard hull sides. The top plate member 15 overhangs the end of the canoe, and the top plate member 15 and the two side support members 30, 40 are all coterminous at the narrower first end 18 of the top plate 15, which shared terminus defines an overall first end of the entire body 10. This overall first end of the body 10 is held at a cantilevered distance from the associated end of the canoe by the overhanging character of the top plate member 15 and the accompanying side support members contiguously running along the lateral edges thereof. Here, the top plate member 15 and the accompanying side support members 30, 40 cooperatively form a cantilevered end region of the body 10 that spans beyond the end of the canoe to support an attached motor mount 60, as described in more detail further below.

The first side support member 30 includes a first section 31 and a second section 32. First section 31 is proximate first end 18 and extends towards the second end 19 approximately half the length of the body 10. The second section 32 is proximate the second end 19 of the body 10 extending to meet first section 31. The second section 32 includes a hanging first segment 36A, an in-turned second segment 36B, and a down-turned third segment 37. Hanging first segment 36A of the second section 32 is contiguous with the first lateral edge 20 of the top plate member 15, being bent perpendicular thereto at a first bend of this section 32 to extend downwardly from the top plate member 15. The in-turned second segment 36B, at a second bend of the second section 32, is bent perpendicular to the hanging first segment 36A to extend laterally inward therefrom. The down-turned third segment 37 of the second section 32 of the first side support member 30 is contiguously formed with the in-turned second segment 36B at a third bend of the second section 32, and is bent perpendicular to the in-turned second segment 36B to hang downward therefrom and parallel to the hanging first segment 36A of the second section 32 of the first side support member 30. The down-turned third segment 37 is adjacent the hull of the canoe 99 proximate the gunwale 98 and provides a surface area for mechanical fastening of the body 10 to the canoe 99. The first section 31 has only a singular bend, located where it contiguously meets the first lateral edge 20 of the top plate member 15, and this singular bend of the first section 31 resides on a shared bend line that is a contiguous extension of the first bend of the second section 32. The first section 31 hangs further downward from the top plate member 15 than the neighboring and parallel hanging first segment 36A of the second section 32. Among the first and second sections 31 & 32, it is the first section 31 that hosts the attachment of the motor mount assembly 60 described further below.

The second side support member 40 includes a first section 41 and a second section 42. First section 41 is proximate first end 18 and extends towards the second end 19 approximately half the length of the body 10. The second section 42 is proximate the second end 19 of the body 10 extending to meet first section 41. The second section 42 includes a hanging first segment 46A, an in-turned second segment 46B, and a down-turned third segment 47. Hanging first segment 46A of the second section 42 is contiguous with the second lateral edge 25 of the top plate member 15, being bent perpendicular thereto at a first bend of this section 42 to extend downwardly therefrom. The in-turned second segment 46B, at a second bend of the second section 42, is bent perpendicular to the hanging first segment 46A and extends laterally inward therefrom. The down-turned third segment 47 of the second section 42 of the second side support member 40 is contiguously formed with the in-turned second segment 46B at a third bend of the second section 42, and is bent perpendicular to the in-turned second segment 46B to hang downward therefrom and parallel to the hanging first segment 46A of the second section 42 of second side support member 40. The down-turned third segment 47 is adjacent the hull of the canoe 99 proximate the gunwale 98 and provides a surface area for mechanical fastening of the body 10 to the canoe 99. The first section 41 has only a singular bend, where it contiguously meets the second lateral edge 25 of the top plate member 15, and this singular bend of the first section 41 resides on a shared bend line that is a contiguous extension of the first bend of the second section 42. The first section 41 hangs further downward from the top plate member 15 than the neighboring and parallel hanging first segment 46A of the second section 42. Among the first and second sections 41 & 42, it is the first section 41 of the second side support member 40 that hosts the attachment of the motor mount assembly 60 described further below. While a specific embodiment of the first side support member 30 and second side support member 40 have been illustrated and discussed herein, it should be understood within the scope of the present invention that the first side support member 30 and second side support member 40 could be provided in alternate configurations and achieve the desired objective discussed herein. By way of example but not limitation, the first side support member 30 and second side support member 40 could be formed having only one section extending the length of the body 10.

Figure 6:
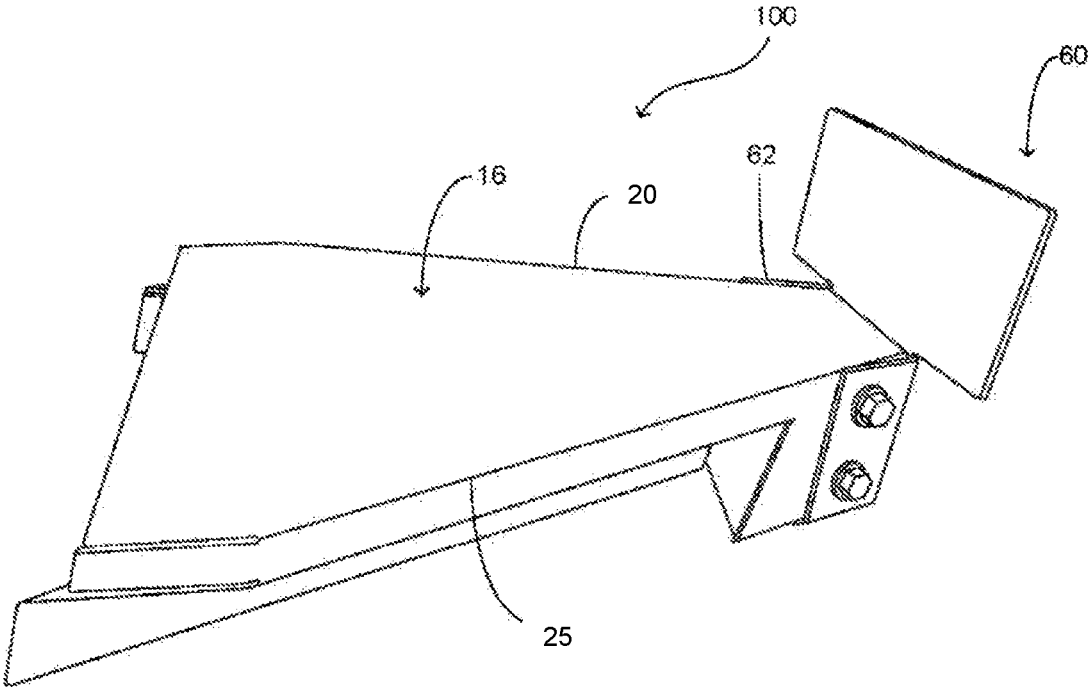
FIG. 6 is a side view of a stern embodiment having the motor mount secured thereto.
Figure 7:
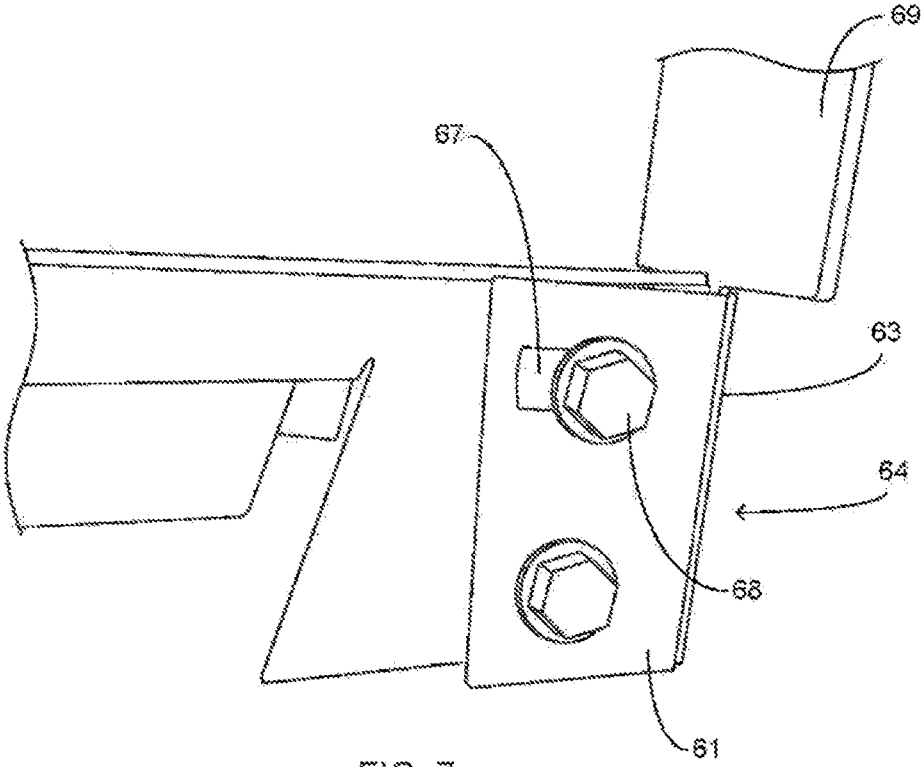
FIG. 7 is a detailed view of a lower portion of the motor mount.

Referring in particular to FIG. 6 and FIG. 7 submitted herewith, the motor mount assembly 60 is illustrated therein. The motor mount assembly 60 is configured to facilitate the operable coupling of an outboard motor 97 to the canoe 99. The motor mount assembly 60 includes a first lateral support plate 61, a second lateral support plate 62 and a rear support plate 63 forming the lower section 64 of the motor mount assembly 60. The first lateral support plate 61 and second lateral support plate 62 extend downward from the top plate member 15. Both the first lateral support plate 61 and second lateral support plate 62 are identically manufactured and are of the same size. Each of the first lateral support plate 61 and second lateral support plate 62 includes an upper aperture 67 that aligns with that of the other lateral support plate and is utilized to receive engagement of fastener 68 commonly through the aligned upper apertures 67 so as to form an operable lock by which to secure the motor mount assembly 60 in position. The upper aperture 67 is rectangular in shape so that the elongated rectangular shape can facilitate pivotal movement of the motor mount assembly 60 about a pivot point. The pivot point is defined by the second illustrated fastener that is situated at a lower elevation than fastener 68, and is engaged through a lower aperture in each lateral support plate. Pivotal movement of the motor mount assembly 60 about this lower pivot point is possible with the fastener 68 in a loosened state, and allows a user to tilt the outboard motor 97 if required. After such angular adjustment of the motor mount assembly 60 relative to the body 10 and canoe 99, the motor mount assembly 60 can be locked at the selected angle by re-tightening of the fastener 68. An upper plate member 69 is contiguously formed with the rear support plate 63 and extends upward beyond the top plate member 15. The upper plate member 69 is a widest part of the motor mount assembly 60 being wider than both the lower portion 64 thereof and the first end 18 of the body 10 that is straddled by the lower portion 64 of the motor mount assembly 60, whereby this wide upper plate member 69 is configured to have the outboard motor 97 secured thereto. Being pivotally attached to the cantilevered end region of the body 10 that projects beyond the end of the canoe 99, the motor mount assembly 60 is supported in a cantilevered position spaced outwardly beyond the end of the canoe 99 and out of contact therewith. It should be understood within the scope of the present invention that the upper plate member 69 could have additional plate members or be provided in alternate shapes and sizes and have the outboard motor 97 secured thereto. It should be understood within the scope of the present invention that the outboard motor 97 could be mounted to either the bow or stern of the canoe.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A canoe end cap that is configured to be secured to a bow end or a stern end of a canoe wherein the canoe end cap comprises:

a body, said body having a first end and a second end, said body having a width at said second end that is greater than a width at said first end, said body comprising:

a top plate having a first lateral edge and a second lateral edge on opposing sides of said body, and an upper surface and a lower surface, among which said lower surface is placeable atop an end of a canoe; and a first side support and a second side support, said first side support being contiguous with said first lateral edge and extending downward therefrom, said second side support being contiguous with said second lateral edge and extending downward therefrom; and a motor mount pivotally attached or attachable to the body proximate the first end thereof at a pivot point about which the motor mount is pivotable relative to the body to permit tilting adjustment of the motor mount into different angular orientations relative to the body and the canoe; and a lock operable to lock the motor mount in any selected one of said different angular orientations relative to the body and the canoe.

2. The canoe end cap as recited in claim 1, wherein the lock comprise at least one elongated aperture and a fastener engaged or engageable therethrough, said at least one elongated aperture being elongated in shape so as to permit said tilting adjustment of the motor mount into said different angular orientations with the fastener in a loosened state, tightening of which is operable to lock the motor mount in said any selected one said different angular orientations.

3. The canoe end cap as recited in claim 2, wherein said at least one elongated aperture comprises two elongated apertures in the motor mount at opposing lateral sides thereof that respectively neighbor the opposing sides of the body, said two elongated apertures being aligned with one another for common penetration thereof by the fastener.

4. The canoe end cap as recited in claim 1 wherein the lock comprises a set of cooperating apertures in the body and the motor mount and a fastener engaged or engageable through aligned apertures and operable to lock the motor mount in said any selected one said different angular orientations.

5. The canoe end cap as recited in claim 4 wherein among said set of cooperating apertures, a subset thereof is characterized by an elongated shape to accommodate movement of the fastener therein, in a loosened state of the fastener, during the tilting adjustment of the motor mount, before locking the motor mount in place via tightening of said fastener.

6. The canoe end cap as recited in claim 5 wherein said subset of the cooperating apertures comprises two elongated apertures in the motor mount at opposing lateral sides thereof that respectively neighbor the opposing sides of the body.

7. The canoe end cap as recited in claim 1 wherein the motor mount straddles the body at the first end thereof.

8. The canoe end cap end cap as recited in claim 1 wherein the body is shaped and dimensioned such that an end portion of the top plate overhangs from the end of the canoe and spans fully to the first end of the body, and the motor mount straddles the body at the first end thereof thereof in a position cantilevered outwardly from the canoe and out of contact therewith.

9. The canoe end cap as recited in claim 1 wherein the motor mount is narrower at a lower portion thereof that pivotally attaches to the body than at an upper portion of the motor mount that is configured for secured mounting of an outboard motor thereto.

10. The canoe end cap as recited in claim 1 wherein the motor mount attaches to the first and second side supports at areas thereof at which the first and second side supports are laterally interconnected by the top plate.

11. A canoe end cap that is configured to be secured to a bow end or a stern end of a canoe wherein the canoe end cap comprises:

a body, said body having a first end and a second end, said body having a width at said second end that is greater than a width at said first end, said body comprising:

a top plate having a first lateral edge and a second lateral edge on opposing sides of said body, and an upper surface and a lower surface, among which said lower surface is placeable atop an end of a canoe; and first and second side supports that are respectively contiguous with said first and second lateral edges of the top plate, and bend downwardly from the top plate at said first and second lateral edges, respectively;

wherein:

each side support has first and second sections that are respectively adjacent to the first and second ends of the body;

the second section of each side support is characterized by a first bend from which a hanging first segment of the second section hangs downwardly from the respectively lateral edge of the top plate, a second bend from which an in-turned second segment of the second section then turns laterally inward from the hanging first segment, and a third bend from which a down-turned third segment the second section then turns downwardly from the in-turned second segment to form a mechanical fastening interface at which the body is mechanically fastenable to the canoe;

the first section of each side support bends downwardly from the respective lateral edge of the top plate on a shared bend line that is a contiguous extension of the first bend of the second section.

12. The canoe end cap recited in claim 11 wherein the first section hangs a greater distance from the shared bend line than the hanging first segment of the second section.

13. The canoe end cap recited in claim 11 wherein the first section of each side support comprises multiple fastening apertures therein at locations thereon that reside beyond the end of the canoe for fastened securement of an additional component to the body.

14. The canoe end cap of claim 13 wherein said fastening apertures comprise upper and lower apertures residing at different elevations on the first section of each side support.

15. The canoe end cap of claim 13 in combination with said additional component, wherein said additional component is a motor mount for secured mounting of an outboard motor thereto.

16. The canoe end cap of claim 15 wherein said motor mount, at a widest portion thereof, is wider than the first end of the body.

17. A canoe end cap that is configured to be secured to a bow end or a stern end of a canoe wherein the canoe end cap comprises:

a body, said body having a first end and a second end, said body having a width at said second end that is greater than a width at said first end, said body comprising:

a top plate having a first lateral edge and a second lateral edge on opposing sides of said body, and an upper surface and a lower surface, among which said lower surface is placeable atop an end of a canoe; and first and second side supports that are respectively contiguous with said first and second lateral edges of the top plate, and bend downwardly from the top plate at said first and second lateral edges, respectively;

wherein the first and second side supports and the top plate all extend fully to the first end of the body, and the top plate overhangs the end of the canoe in cooperative formation with the first and second side supports of a cantilevered end region of the body that spans beyond the end of the canoe and is wider than said end of the canoe, to enable mounted support thereon of an outboard motor.

18. The canoe end cap of claim 17 further comprising a motor mount attached or attachable to the cantilevered end region of the body for indirect support thereon of the outboard motor by said motor mount.

19. The canoe end cap of claim 18 wherein said motor mount, at a widest portion thereof, is wider than the first end of the end cap.

20. The canoe end cap of claim 18 wherein said motor mount is adjustably tiltable on the cantilevered support between a plurality of different angular orientations relative thereto, and selectively lockable in any selected one of said plurality of different angular orientations.

* * * * *